US012550950B1

(12) United States Patent
Ferlet

(10) Patent No.: US 12,550,950 B1
(45) Date of Patent: Feb. 17, 2026

(54) COMBINED BIB AND CAP GARMENT

(71) Applicant: Rebecca A. Ferlet, Corsicana, TX (US)

(72) Inventor: Rebecca A. Ferlet, Corsicana, TX (US)

( * ) Notice: Subject to any disclaimer, the term of this patent is extended or adjusted under 35 U.S.C. 154(b) by 0 days.

(21) Appl. No.: 18/799,468

(22) Filed: Aug. 9, 2024

(51) Int. Cl.
*A41B 13/10* (2006.01)
*A42B 1/04* (2021.01)

(52) U.S. Cl.
CPC ..... *A41B 13/10* (2013.01); *A42B 1/04* (2013.01)

(58) Field of Classification Search
CPC ..... A41B 13/10; A41B 13/103; A42B 1/04; A42B 1/045
See application file for complete search history.

(56) References Cited

U.S. PATENT DOCUMENTS 623,086 A * 4/1899 Kaufman ..... A41D 3/04 2/84
640,720 A * 1/1900 Thronton ..... A42B 1/04 2/204
781,232 A * 1/1905 Saks ..... A42B 1/045 2/203
1,051,229 A * 1/1913 Hoeflich ..... A42B 1/04 2/204
1,075,247 A * 10/1913 Fiori ..... A42B 1/045 2/202
1,167,058 A * 1/1916 Finberg ..... A41D 3/08 5/413 R
1,200,528 A * 10/1916 Ryder ..... A42B 1/16 2/10
1,211,807 A * 1/1917 Aidenland ..... A42B 1/045 2/203
1,338,187 A * 4/1920 Mainthow ..... A41D 11/00 2/84
1,423,315 A * 7/1922 Geis ..... A41D 3/08 296/81
1,897,100 A * 2/1933 Ione ..... A42B 1/045 132/274
2,125,739 A * 8/1938 Rosenberg ..... A42B 1/045 2/195.8
2,131,248 A * 9/1938 Astrove ..... A42B 1/045 2/84
2,462,679 A * 2/1949 Rosenau ..... A42B 1/201 D2/870
2,644,948 A * 7/1953 Gutmann ..... A47G 9/086 5/413 R
2,696,007 A * 12/1954 Larkin ..... A42B 1/08 D2/874
2,735,283 A * 2/1956 Schuessler ..... A42B 1/045 2/202
3,059,377 A * 10/1962 Brown ..... A63H 3/52 446/139

(Continued)

*Primary Examiner* — Heather Mangine
*Assistant Examiner* — Raquel M. Weis
(74) *Attorney, Agent, or Firm* — Cramer Patent & Design, PLLC.; Aaron R. Cramer

(57) ABSTRACT

The disclosed device is a combined garment for children, merging a cap and bib into one piece. Made from versatile materials, including lightweight, waterproof, and hypoallergenic options, the cap is dome-shaped with adjustable ear flaps for a comfortable fit. The bib, attached to the cap, features an easy-access opening with a secure fastening around the neck and an expandable pocket at the bottom designed to catch spills. This all-in-one garment offers a convenient solution to keep children clean, combining practicality with comfort in use.

2 Claims, 7 Drawing Sheets

(56) References Cited

U.S. PATENT DOCUMENTS 3,522,612 A * 8/1970 Palmer ..... A41D 15/00 2/84
3,540,060 A * 11/1970 Brown ..... A41B 13/103 D2/864
3,879,762 A * 4/1975 Herman ..... A41B 13/10 2/48
4,370,755 A * 2/1983 Crumby ..... A41D 3/08 2/84
4,384,371 A * 5/1983 Sonne ..... A42B 1/205 2/209.12
4,484,362 A * 11/1984 Asher ..... A45F 3/22 5/413 R
4,523,333 A * 6/1985 Spangler ..... A61F 13/58 2/49.3
4,541,128 A * 9/1985 Will ..... A41D 3/08 2/84
4,646,365 A * 3/1987 Suprise ..... A41B 13/103 2/51
D296,605 S * 7/1988 Asher ..... 2/69
4,975,982 A * 12/1990 Hughes ..... A41B 13/10 2/49.1
4,975,984 A * 12/1990 Sting ..... A41D 13/04 2/88
5,168,579 A * 12/1992 Marshall ..... A41D 3/08 2/87
5,211,668 A * 5/1993 Secord ..... A42B 1/046 2/202
5,312,282 A * 5/1994 Cooper ..... A61J 9/00 215/11.1
5,351,343 A * 10/1994 Harbison ..... A42B 1/0188 2/172
5,664,258 A * 9/1997 Harris ..... A41D 3/08 2/84
5,664,259 A * 9/1997 Budd ..... A41D 15/00 2/209.12
H1738 H * 7/1998 Reinhart, Jr. ..... A41B 13/10 2/49.1
5,822,792 A * 10/1998 Reinhart, Jr. ..... A41B 13/10 2/243.1
5,930,837 A * 8/1999 Anvar ..... A41B 13/10 2/49.1
5,960,471 A * 10/1999 Burton ..... A41D 1/215 2/48
6,128,781 A * 10/2000 Spindler ..... A41B 13/106 2/49.3
D433,787 S * 11/2000 Bellon ..... D2/717
6,275,993 B1 * 8/2001 McCarley ..... A41D 15/04 2/84
6,401,248 B1 * 6/2002 Christensen ..... A41D 3/08 2/69
6,532,596 B1 * 3/2003 Fosmo ..... A42B 1/045 2/202
6,745,399 B1 * 6/2004 Austin ..... A41B 13/103 248/102
6,799,330 B1 * 10/2004 Lansdell ..... A41B 13/10 2/49.4
7,032,248 B1 * 4/2006 Gutilla ..... A41B 13/10 2/49.1
7,137,150 B2 * 11/2006 Larson ..... A42B 1/206 2/202
7,269,856 B1 * 9/2007 Cannan ..... A41B 13/10 2/49.4
7,716,749 B2 * 5/2010 Perazzo ..... A41B 13/106 2/49.3
D679,484 S * 4/2013 Brown ..... D2/823
9,254,013 B2 * 2/2016 Perez ..... A42B 1/006
9,282,778 B1 * 3/2016 Ingram ..... A42B 1/24
9,392,821 B1 * 7/2016 Baker ..... A41B 13/103
9,420,833 B2 * 8/2016 Jenkins ..... A41D 11/00
9,585,430 B1 * 3/2017 Singh ..... A42B 1/04
10,034,499 B2 * 7/2018 Blackshear ..... A41B 13/103
11,000,112 B1 * 5/2021 Thomas ..... A45F 4/12
2003/0126672 A1 * 7/2003 Giggleman ..... A42B 1/206 2/202
2006/0010555 A1 * 1/2006 Hayes ..... A41D 13/0015 2/69
2009/0019615 A1 * 1/2009 Young ..... A41B 13/10 2/49.1
2009/0126078 A1 * 5/2009 Rashid ..... A42B 1/045 2/207
2010/0064412 A1 * 3/2010 Slutzky ..... A41D 11/00 2/243.1
2012/0030858 A1 * 2/2012 Duffin ..... A42B 1/04 2/183
2012/0174279 A1 * 7/2012 Bailey ..... A41B 13/103 2/48
2012/0185990 A1 * 7/2012 Jewison ..... A41B 13/10 2/48
2016/0095359 A1 * 4/2016 Fox ..... A62B 17/04 2/84
2017/0318885 A1 * 11/2017 Smith ..... A42B 1/041
2018/0220715 A1 * 8/2018 Bisson ..... A41B 13/103
2019/0223518 A1 * 7/2019 Schutte ..... A41B 13/10
2019/0274367 A1 * 9/2019 Bolling ..... A41B 13/08
2021/0378867 A1 * 12/2021 Schoenberg ..... A61F 9/045
2022/0095731 A1 * 3/2022 Carey ..... A62B 18/086
2022/0256957 A1 * 8/2022 Nakamura ..... A42B 1/0187
2023/0067718 A1 * 3/2023 Hopkins ..... A41B 13/10
2023/0404174 A1 * 12/2023 Wu ..... B32B 7/12

* cited by examiner

COMBINED BIB AND CAP GARMENT

RELATED APPLICATIONS

None.

FIELD OF THE DEVICE

The present device pertains to the field of children's clothing, more specifically to protective wear for infants and young children designed to maintain cleanliness during feeding and play activities having a combined bib and cap.

BACKGROUND OF THE DEVICE

Traditional children's wear for feeding and playtime typically involves separate articles of clothing, such as bibs and hats, to protect the child's clothing and skin from spills, stains, and environmental elements. Conventional bibs protect only the front torso area and require additional components, such as hats or caps, to protect the head and hair during meals, particularly when children are learning to feed themselves, which can be a messy process.

Furthermore, current protective garments are often made from materials that may not provide the desired combination of comfort, hypoallergenic properties, and durability. Parents and caregivers have to contend with multiple items of clothing that can be cumbersome to put on and take off, especially when dealing with uncooperative children.

There is a recognized need for an improved protective garment that can offer comprehensive coverage and be easily adjusted to fit the child comfortably while being made of materials suitable for various needs, including disposability, environmental friendliness, and long-term use. The device aims to address these needs by providing a unitary garment that combines the protective features of a bib and cap while offering a convenient and practical solution for children's protective wear.

SUMMARY OF THE DEVICE

Embodiments of the present disclosure may include a combined garment including a cap portion having a generally dome-shaped structure with an inner side configured to at least partially encircle a top of a head of a user. Embodiments may also include a cap front end terminating adjacent to a wearer's hairline.

Embodiments may also include a pair of ear flaps depending downward from the cap front end and terminating adjacent to a bottom of an ear of a user, each ear flap having an affixed drawstring for adjusting an effective diameter of the cap portion. Embodiments may also include a bib portion integrally formed with the cap portion and having a top end extending from a bottom end of the cap portion.

Embodiments may also include a bottom end opposite the top end. Embodiments may also include an upper front side and an upper rear side extending from a cap inner side. Embodiments may also include a lower front side and a lower rear side extending from a cap outer.

Embodiments may also include the lower sides have a larger width than the upper sides. Embodiments may also include an opening centrally located on the upper front and rear sides configured to allow passage of a wearer's head and neck. Embodiments may also include an adjustable fastening means located adjacent to the opening on the upper rear. Embodiments may also include a pocket portion extending from the bib portion with side walls affixed to side. Embodiments may also include edges of the front and second sides of the pocket portion, defining a pocket interior.

In some embodiments, the cap portion and the bib portion may be composed of a unitary construction of material selected from the group consisting of lightweight, waterproof, hypoallergenic, resilient materials, disposable materials, biodegradable materials, cloth, and synthetic materials. In some embodiments, the adjustable fastening means may include two straps with a hook-and-loop fastening mechanism.

In some embodiments, the bib portion may include an elastic band affixed to the lower front side capable of retaining an object. In some embodiments, the pocket portion may include a pocket top end being an extension of the body bottom end of the bib portion. Embodiments may also include a pocket bottom end opposite the pocket top end and flaring out therefrom. Embodiments may also include a flexible or pleated pocket side walls enabling movement of the pocket front side relative to the pocket second side to access the pocket interior.

In some embodiments, the cap portion, the bib portion, and the pocket portion may be coextensive in width and thickness. In some embodiments, the opening of the bib portion may be oval-shaped to facilitate the ease of passage of the wearer's head and neck.

In some embodiments, the drawstrings of the ear flaps may be configured to manually adjust the effective diameter of the cap portion for securing the cap portion under a chin of the user. In some embodiments, the cap portion, bib portion, and pocket portion may be constructed as a transparent unitary garment.

Embodiments may also include a method of using the combined garment, the method including the steps of first, placing the cap portion on a wearer's head such that the inner side of the cap portion at least partially encircles the top of the wearer's head; second, adjusting the cap portion to a desired diameter using the drawstrings affixed to the ear flaps; third, passing the wearer's head and neck through the opening of the bib; fourth, securing the adjustable fastener around the neck of a user; fifth, retaining an object with an elastic band affixed to the lower front side of the bib portion; last, utilizing a pocket side walls to manipulate a pocket front side relative to the pocket second side to capture and collect spilled items within the pocket interior.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
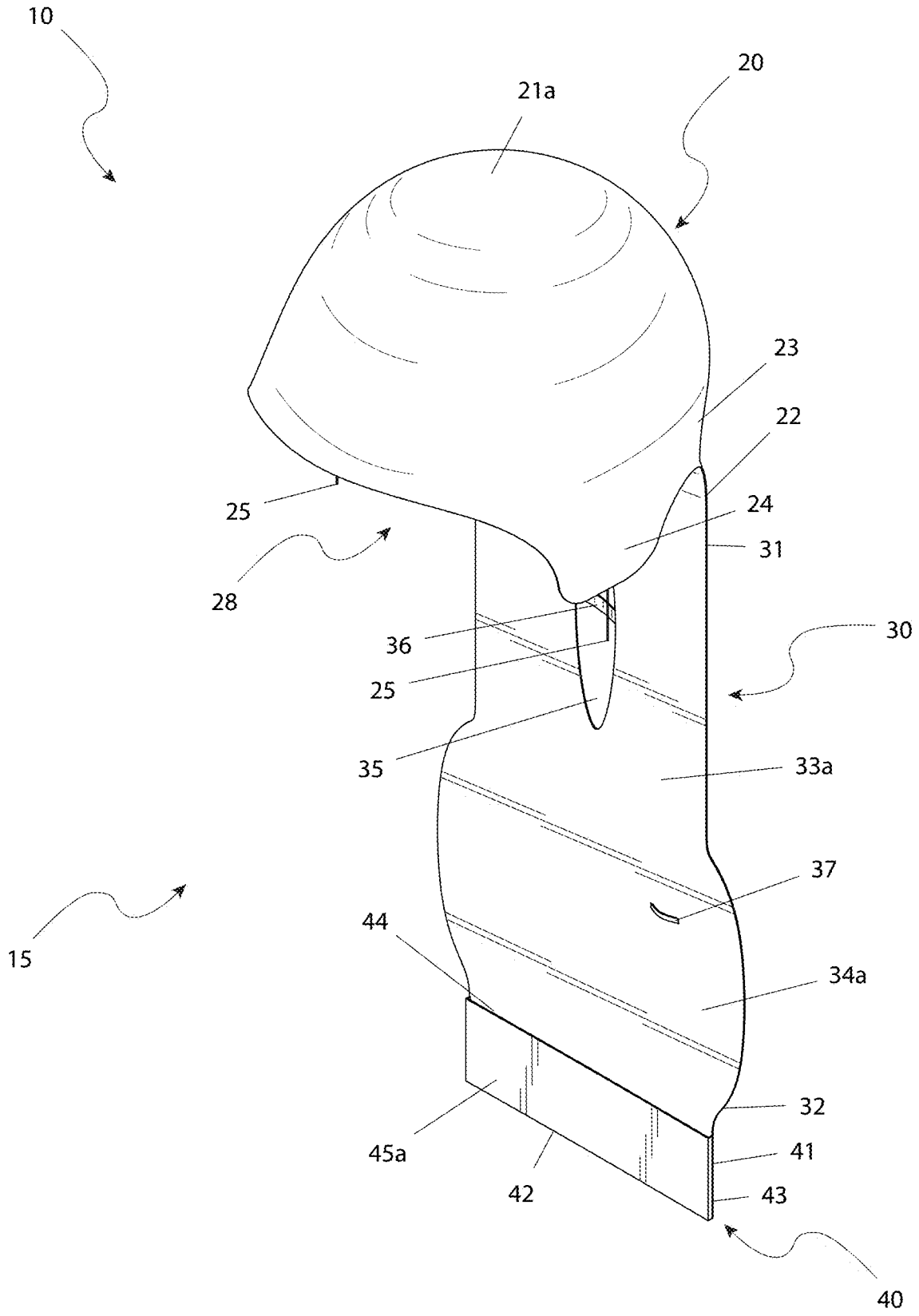
FIG. 1 is a top front right perspective view of a combined bib and cap garment 10, according to the preferred embodiment of the present device.
Figure 2:
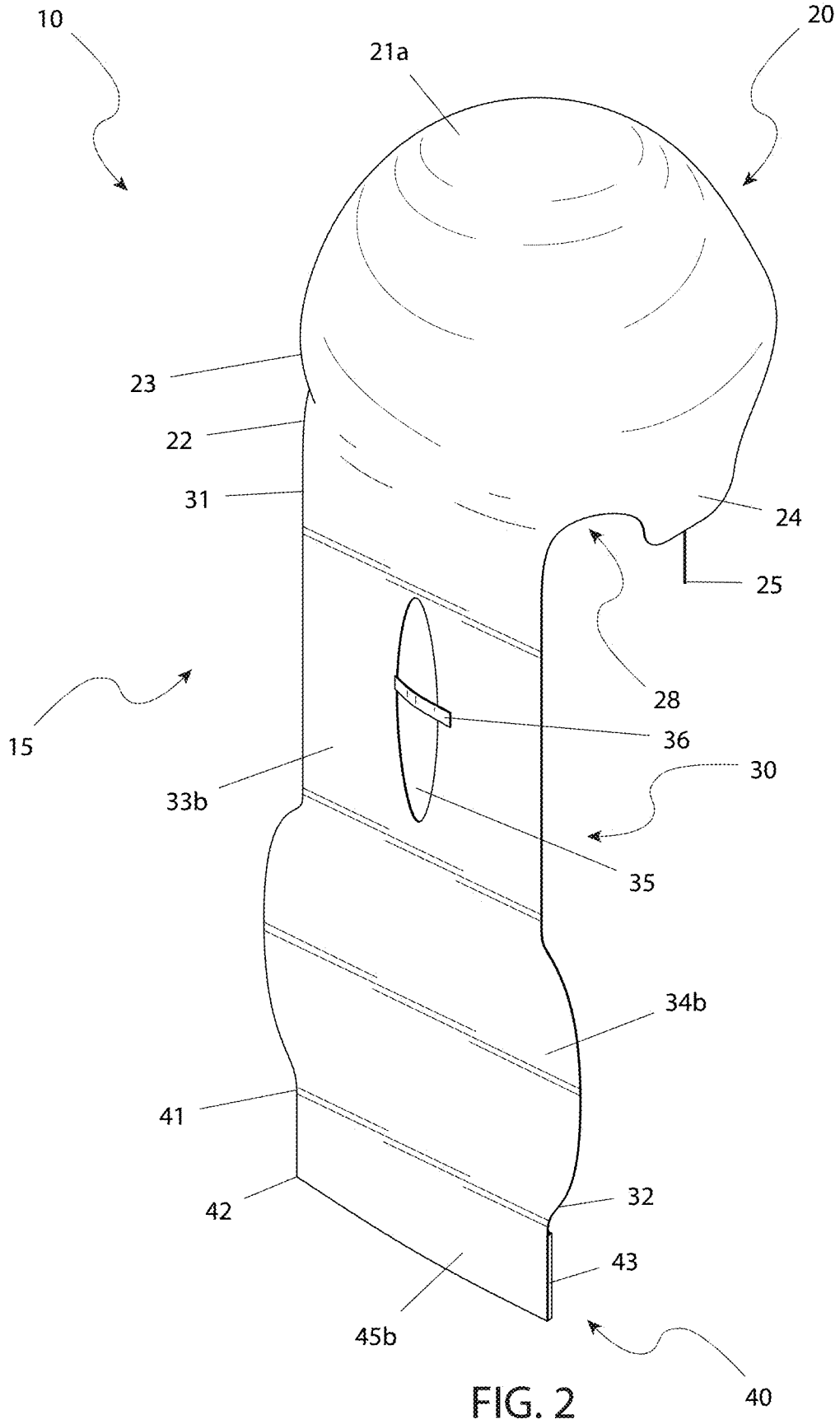
FIG. 2 is a top rear left perspective view of the combined bib and cap garment 10, according to the preferred embodiment of the present device.
Figure 3:
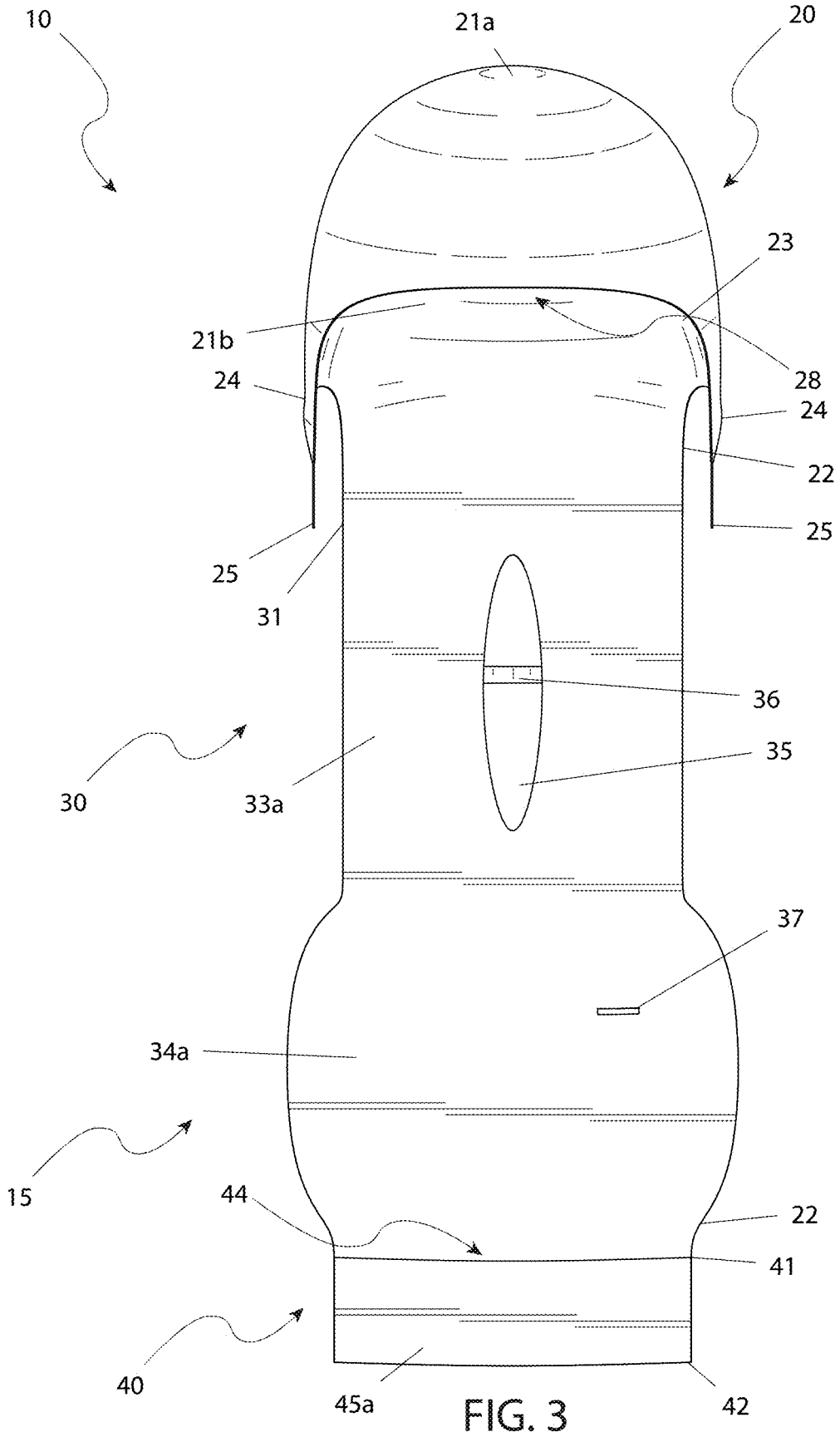
FIG. 3 is a front view of the combined bib and cap garment 10, according to the preferred embodiment of the present device.
Figure 4:
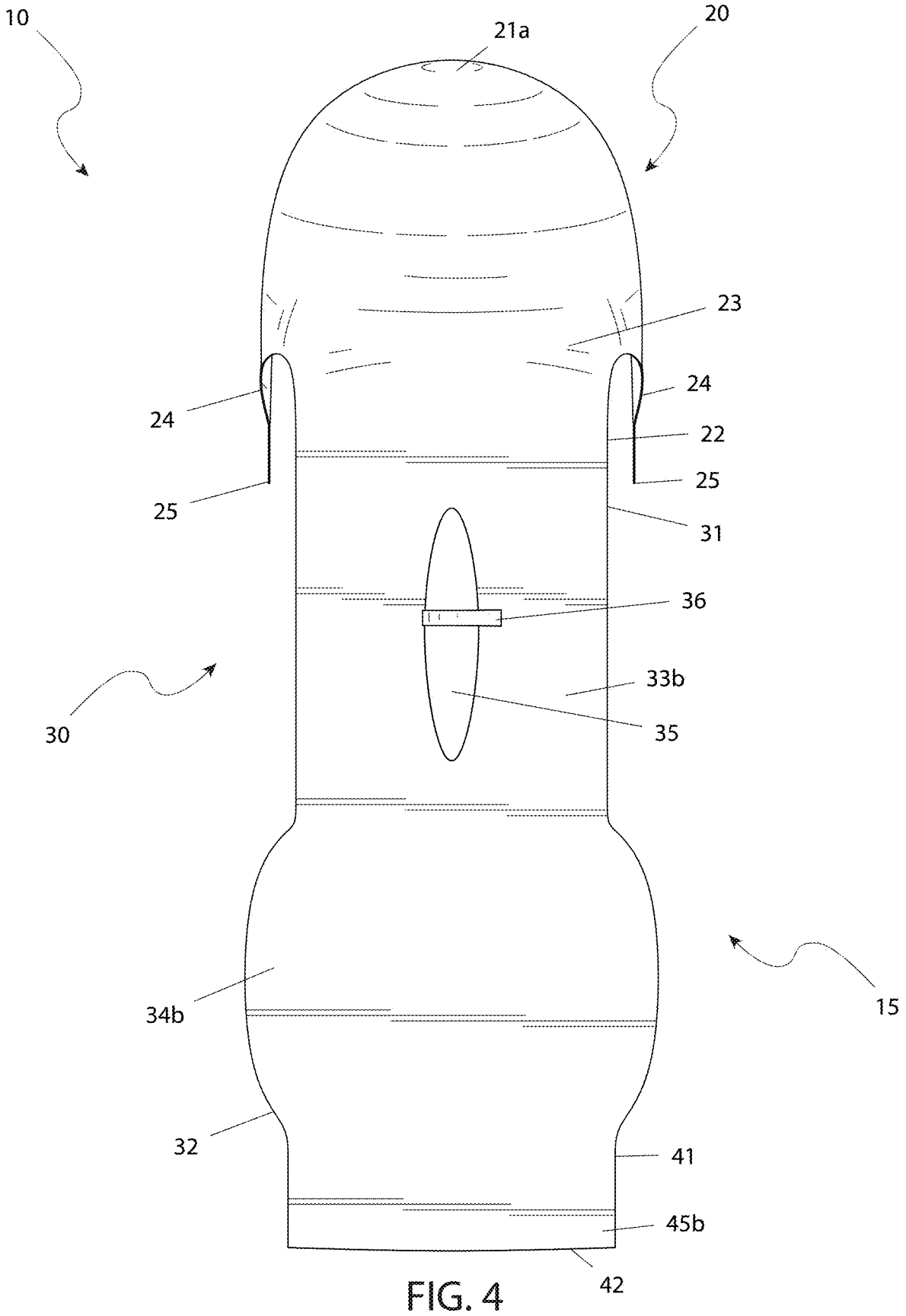
FIG. 4 is a rear view of the combined bib and cap garment 10, according to the preferred embodiment of the present device.
Figure 5:
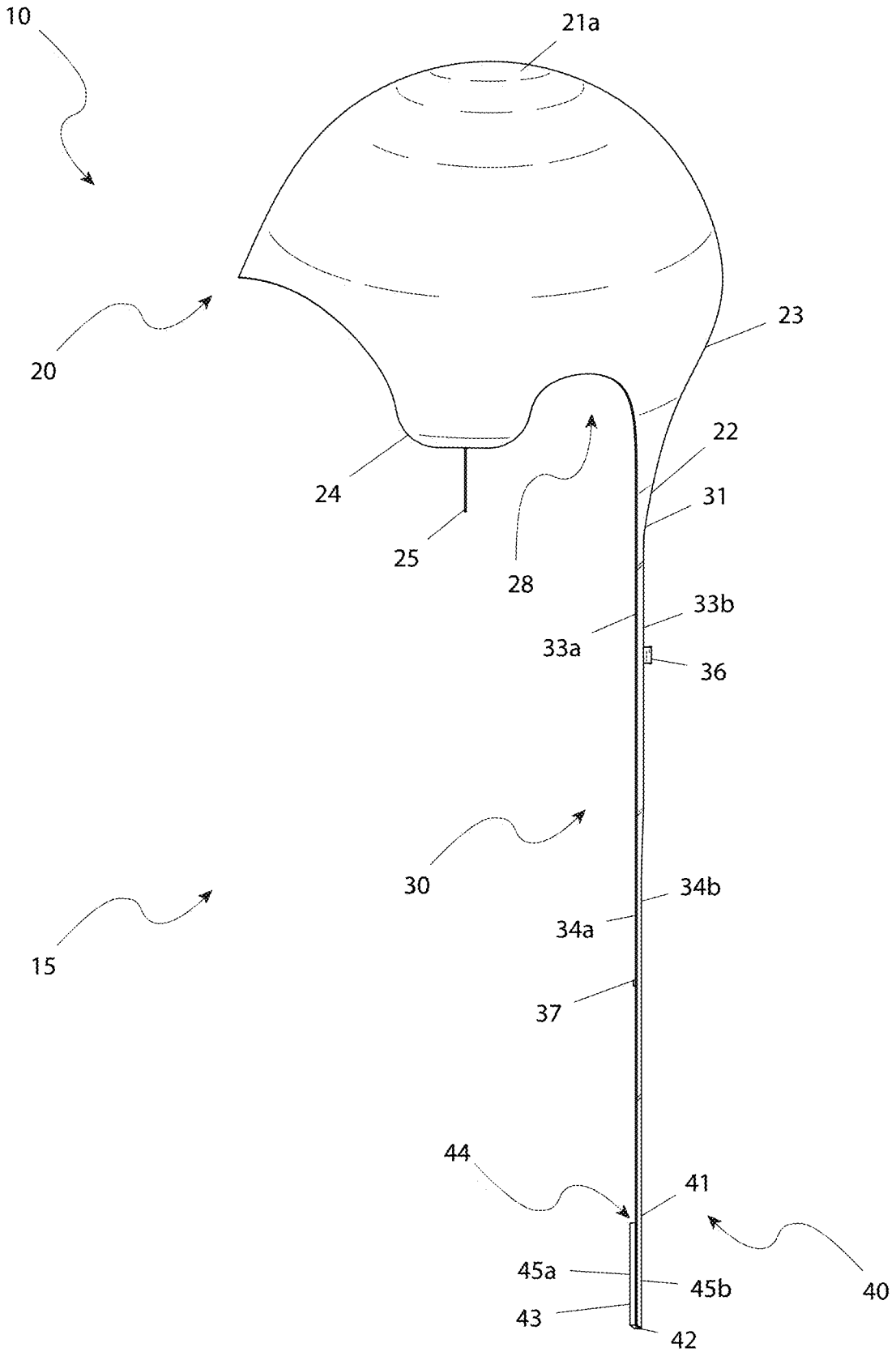
FIG. 5 is a side view of the combined bib and cap garment 10, according to the preferred embodiment of the present device.
Figure 6:
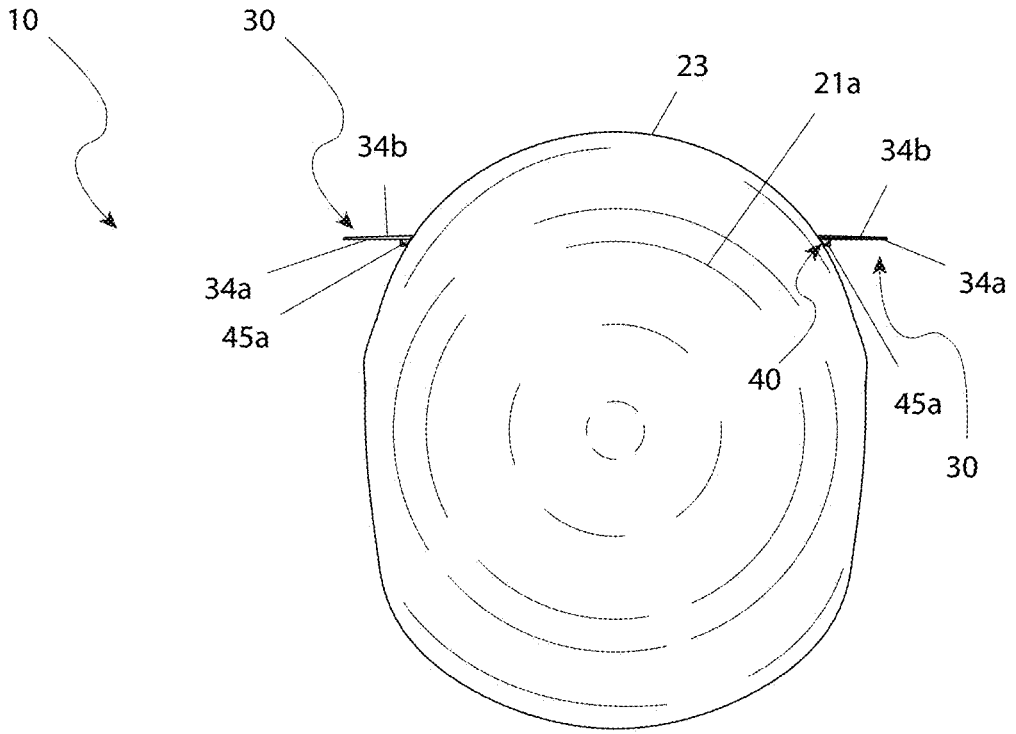
FIG. 6 is a top view of the combined bib and cap garment 10, according to the preferred embodiment of the present device.
Figure 7:
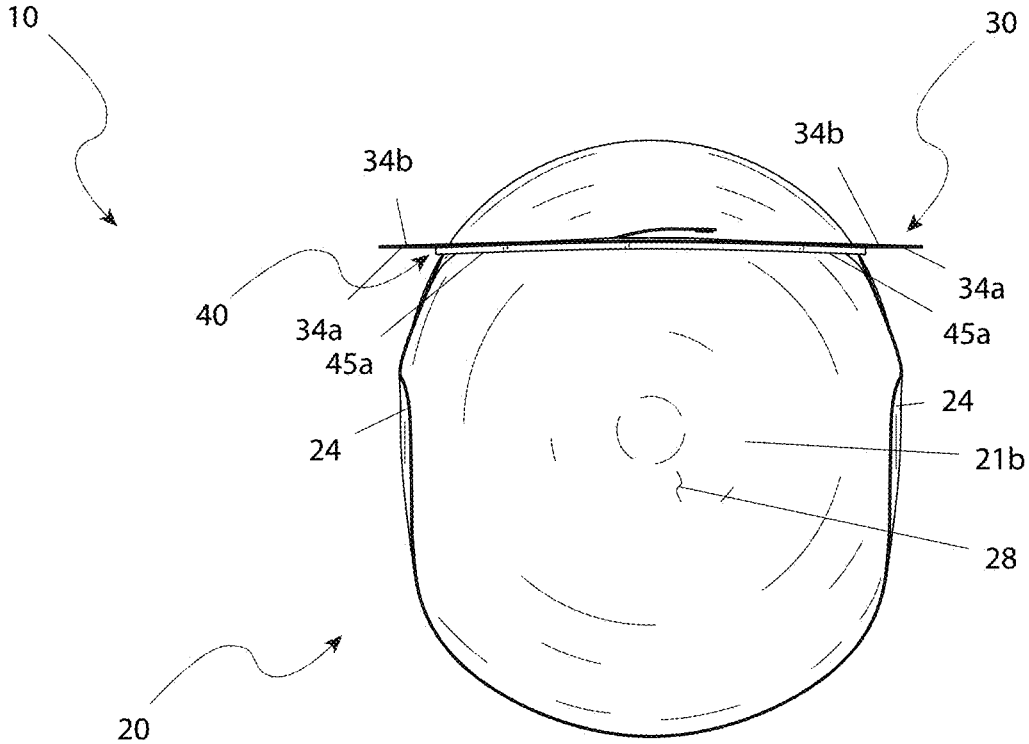
FIG. 7 is a bottom view of the combined bib and cap garment 10, according to the preferred embodiment of the present device.

10 combined bib and cap garment
15 bib
20 cap
21*a* cap inner side
21*b* cap outer side
22 cap bottom
23 cap front end
24 ear flap
25 drawstring
28 cap interior
30 body
31 body top end
32 body bottom end
33*a* body upper front side
33*b* body upper rear side
34*a* body lower front side
34*b* body lower rear side
35 opening
36 fastening means
37 elastic band
40 pocket
41 pocket top end
42 pocket bottom end
43 pocket side wall
44 pocket interior
45*a* pocket front side
45*b* pocket second side
50 child
51 head
52 neck
53 torso
54 lap
60 spilled food
65 object

DESCRIPTION OF THE PREFERRED EMBODIMENTS

Figure 8B:
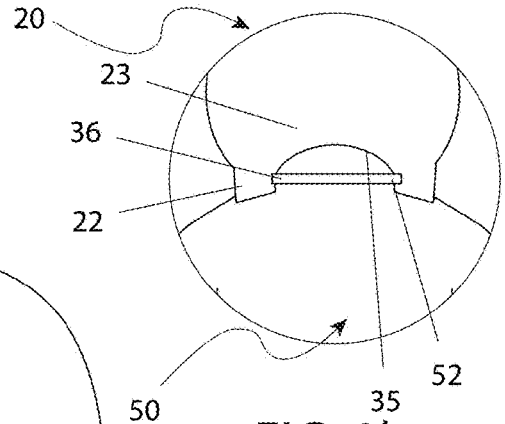
FIG. 8*a* is an environmental view of a child 50 wearing the combined bib and cap garment 10 during a feeding time, according to the preferred embodiment of the present device; and, FIG. 8*b* is a close-up view of a rear side of the combined bib and cap garment 10, according to the preferred embodiment of the present device.
Figure 8A:
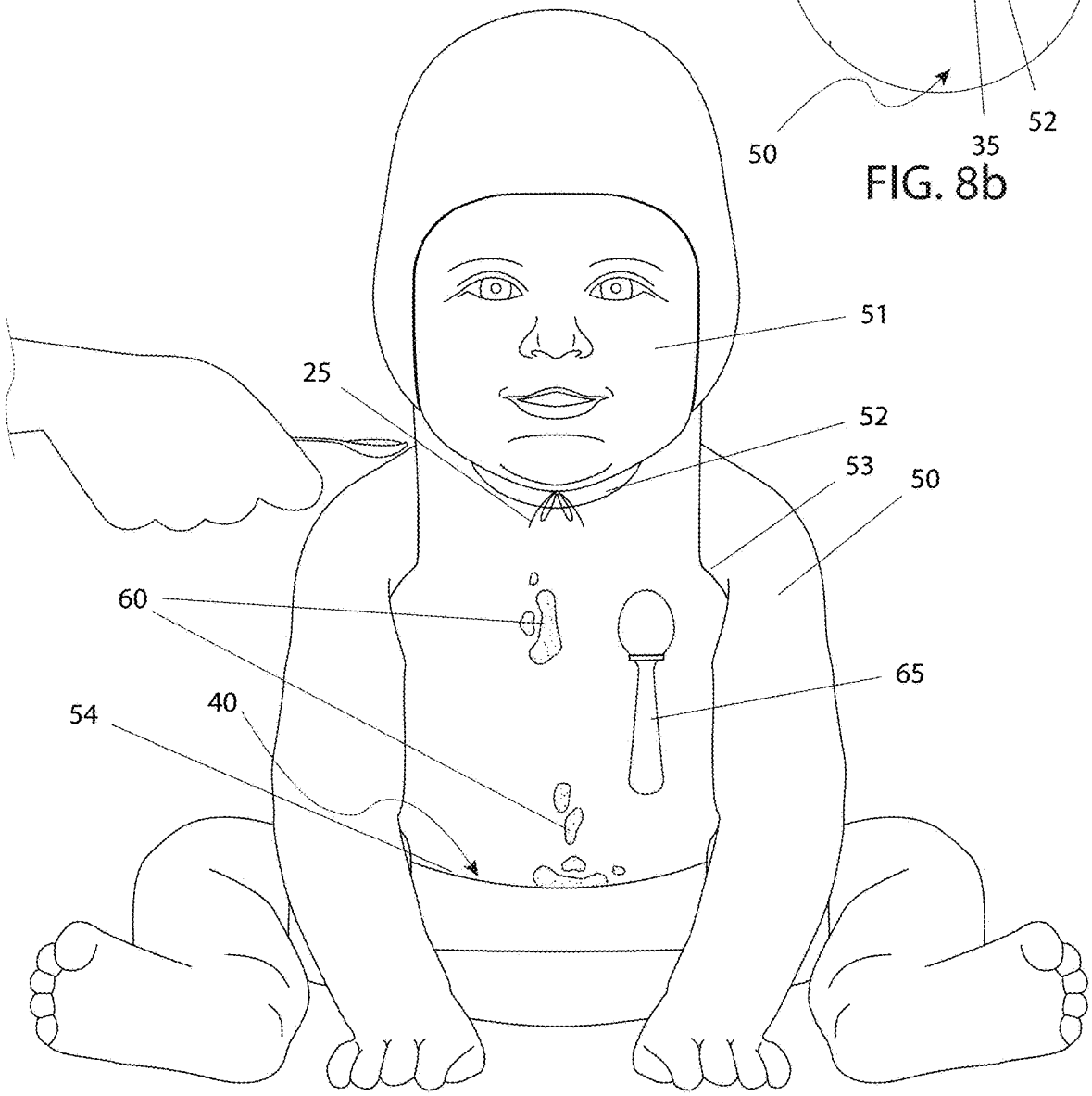

The best mode for carrying out the device is presented in terms of its preferred embodiment, herein depicted within FIGS. 1 through 7, and shown in an exemplary method of use as illustrated in FIGS. 8*a* and 8*b*. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIGS. 1-7, various views of a combined bib and cap garment 10, according to the preferred embodiment of the present device is disclosed. The combined bib and cap garment (herein also described as the "garment") 10, provides for a unitary construction of a lightweight, waterproof, hypoallergenic, resilient, and comfortable material that also may comprise materials that may be disposable, biodegradable, or meant for continued use, such as cloth or synthetic materials (e.g. taffeta, polyester, etc.). The garment 10 essentially comprises a bib 15 and a cap 20 that are integral portions of the overall garment 10, such that the garment 10 may be designed as a unitary construction.

The cap 20 comprises a generally dome-shaped structure that has a cap inner side 21*b* and a cap outer side 21*a*. The cap inner side 21*b* has a shape and size configured to rest on and at least partially encircle a top of a head 51 of a child 50 (please see FIG. 8*a*). A cap interior 28 is defined as the space bounded by the cap inner side 21*b*. The cap 20 has a cap front end 23, a continuous curved edge, that terminates adjacent a hairline of a head 51 of a child 50, preferably so vision is not impaired. The rear ends of the cap front end 23 terminate at front ends of ear flaps 24 that depend downward therefrom and terminate adjacent a bottom of an ear of a head 51 of a child 50. Each ear flap 24 has a drawstring 25 affixed thereto. The drawstrings 25 are capable of drawing together to manually adjust the effective diameter of the cap 20. The rear of the ear flaps 24 connected to a front surface of the cap inner side 21*b*. At the bottom of the cap 20 is a cap bottom 22.

The bib 15 comprises a generally planar embodiment, where a body top end 31 may be an extension of the cap bottom end 22. The body bottom end 32 is located opposite the body top end 31. A body upper front side 33*a* and a body lower front side 34*a* are located on a front side of the bib 15 and are extensions of the cap inner side 21*b*. A body upper rear side 33*b* and a body lower rear side 34*b* are located on a rear side of the bib 15 and are extensions of the cap outer side 21*a*. The body lower front side 34*a* and body lower lower rear side 34*b* may have a larger width than the body upper front side 33*a* and body upper rear side 34*b*, respectively. The body bottom end 32 is located immediately subjacent the body lower front side 34*a* and body lower rear side 34*b* and is preferably of the same width as the body upper front side 33*a* and body upper rear side 33*b*.

An opening 35 is centrally located on the body upper front side 33*a* and body upper rear side 33*b* and is preferably oval-shaped or shaped to configure ease of passage of a head 50 and neck 52 of a child 50 therethrough. A fastening means 36 is affixed to surfaces of the body upper rear side 33*b*, adjacent the opening 35. In at least one (1) embodiment, the fastening means 36 may be two (2) straps with a hook-and-loop-type of an adjustable fastening mechanism. Located on the body lower front side 34*a* is an elastic band 37 affixed thereto, capable of retaining an object 65 therein.

The pocket is an extension of the bib 15 such that a pocket top end 41 is an extension of the body bottom end 40. The pocket bottom end 42 is opposite the pocket top end 40 and may flare out slightly therefrom (i.e., have a larger width). A pair of pocket side walls 43 each has a top side affixed to top ends of side edges of a pocket front side 45*a* to top ends of side edges of a pocket second side 45*b* (i.e., adjacent the pocket top end 41). The pocket side walls 43 each are affixed concurrently to the bottom ends of the side edges of the pocket front side 45*a* and pocket second side 45*b*. The pocket side walls 43 may be flexible or pleated to enable the pocket front side 45*a* to forwardly move relative to the pocket second side 45*b*. A pocket interior 44 is defined as the space between the inner facing surfaces of the pocket front side 45*a* and pocket second side 45*b* and the pocket bottom end 42.

In a preferred embodiment, the cap 20, bib 15, and pocket 40 portions all are coextensive in width and thickness. In other embodiments, the body upper front side 33*a* and body upper rear side 33*b* have a width smaller than the width of the body lower front side 34*a* and body lower rear side 34*b*. In still other embodiments, the ear flaps 24 are identical in size and shape and the front and rear ends of the ear flaps 24 are generally the same length from the apex of the cap 20. This effectively produces as unitary garment 10 having an overall continuous width and thickness. The garment 10 may be transparent.

2. Operation of the Preferred Embodiment

The preferred embodiment of the present device can be utilized by the common user in a simple and effortless manner with little or no training. It is envisioned that the garment 10 would be worn in general accordance with FIGS. 8*a* and 8*b* by a child 50 or any other user. The garment 10 is to be worn, generally, such that the cap 20 is comfortably worn on the head 51 and the drawstrings 25 are interconnected and comfortably secure the desired diameter of the cap 20 about the chin of the head 51. This best occurs when the neck 52 and head 51 are placed through the opening 25 of the bib 15 such that the neck 52 and head 51 are on the front side of the garment 10. The fastening means 36 may comfortably secure around the neck 52. The torso 53 and lap 54 are thusly located on the rear side of the garment 10 and are effectively covered by the bib 15 and pocket 40. The elastic band 37 may securely retain an object 65, such as a utensil or toy to the bib 15. The pocket interior 44 of the pocket 40 may be accessible by manipulating the pocket side walls 43 as necessary to capture and collect any spilled food 60 as may happen during a typical feeding action.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A combined bib and cap garment, comprising:

a cap having a dome-shaped structure with a cap inner side and a cap outer side defining a cap interior, the cap including; a cap front end formed as a continuous curved edge and a cap bottom;

a pair of ear flaps depending downward from the cap front end, each ear flap having a drawstring, rear ends of the ear flaps being affixed to a front surface of the cap inner side such that the drawstring of each ear flap is configured to manually adjust an effective diameter of the cap when worn;

a bib integrally formed with the cap such that a body top end of the bib is an extension of the cap bottom, the bib including; a body upper front side and a body upper rear side contiguous with the cap inner side;

a body lower front side and a body lower rear side contiguous with the cap outer side, and a body bottom end located immediately subjacent the body lower front side and the body lower rear side, wherein the body lower front side and the body lower rear side have a larger width than the body upper front side and the body upper rear side, and wherein the body bottom end has a width substantially equal to widths of the body upper front side and the body upper rear side;

an opening centrally located on the body upper front side and the body upper rear side and shaped to allow passage of a wearer's head and neck;

an adjustable fastener affixed to the body upper rear side adjacent the opening, the adjustable fastener comprising first and second straps each bearing complementary hook-and-loop fastener material; and, a pocket extending from the bib and including a pocket top end that is an extension of the body bottom end, a pocket bottom end opposite the pocket top end, a pocket front side, a pocket second side, and a pair of pocket side walls, each pocket side wall affixed at a top side to top ends of side edges of the pocket front side and the pocket second side adjacent the pocket top end and affixed at a bottom side to bottom ends of the side edges of the pocket front side and the pocket second side so as to define with the pocket front side, the pocket second side, and the pocket bottom end a pocket interior; and, wherein the cap front end is configured to terminate adjacent to a wearer's hairline when worn and, when the garment is worn, the wearer's head and neck are disposed on a front side of the garment and the bib and the pocket are disposed on a rear side of the garment to collect spilled food.

2. The combined bib and cap garment of claim 1, wherein the pocket side walls are pleated to enable the pocket front side to move forward relative to the pocket second side in order to access the pocket interior, and wherein the cap, the bib, and the pocket are coextensive in width and thickness, and wherein the ear flaps are identical in size and shape with front and rear ends of substantially equal length from an apex of the cap, and wherein the garment is formed as a unitary construction of a lightweight, waterproof, hypoallergenic, resilient material suitable for disposable, biodegradable, or continued-use cloth or synthetic implementations.

* * * * *